US011111102B2

(12) United States Patent
Schmolke et al.

(10) Patent No.: US 11,111,102 B2
(45) Date of Patent: Sep. 7, 2021

(54) SLIVER CAN INCLUDING A DISPLAY ELEMENT FOR DISPLAYING PROPERTIES OF THE FIBER MATERIAL

(71) Applicant: Maschinenfabrik Rieter AG, Winterthur (CH)

(72) Inventors: Werner Schmolke, Ingolstadt (DE); Markus Hillerbrand, Ingolstadt (DE)

(73) Assignee: Maschinenfabrik Rieter AG, Winterthur (CH)

( * ) Notice: Subject to any disclaimer, the term of this patent is extended or adjusted under 35 U.S.C. 154(b) by 149 days.

(21) Appl. No.: 16/527,287

(22) Filed: Jul. 31, 2019

(65) Prior Publication Data

US 2020/0039780 A1 Feb. 6, 2020

(30) Foreign Application Priority Data

Aug. 1, 2018 (DE) ..... 10 2018 118 652.5

(51) Int. Cl.
*B65H 75/16* (2006.01)

(52) U.S. Cl.
CPC ..... *B65H 75/16* (2013.01)

(58) Field of Classification Search
CPC ..... B65H 75/16
See application file for complete search history.

(56) References Cited

U.S. PATENT DOCUMENTS 4,021,795 A * 5/1977 Hollingsworth ..... D01H 13/14 19/150
4,213,536 A * 7/1980 Hafner ..... B29C 45/14344 206/407
4,683,619 A * 8/1987 Langen ..... D01H 9/185 19/159 A
4,939,895 A * 7/1990 Raasch ..... D01H 9/008 57/263
5,276,947 A 1/1994 Fritschi et al.
5,307,250 A * 4/1994 Pearson ..... A47G 23/0309 200/85 R
5,311,645 A * 5/1994 Schwalm ..... D01H 11/005 19/159 A (Continued)

FOREIGN PATENT DOCUMENTS

CN 202765975 U 3/2013
CN 204454083 U 7/2015

(Continued)

OTHER PUBLICATIONS

German Patent Office Search Report, dated Jan. 22, 2019.
EPO Search Report, dated Dec. 12, 2019.

*Primary Examiner* — Shaun R Hurley
(74) *Attorney, Agent, or Firm* — Dority & Manning, P.A.

(57) ABSTRACT

A sliver can for accommodating a strand-shaped fiber material includes a can base and a peripheral side wall that delimits an accommodating space for the fiber material, the peripheral side wall at least partially transparent. A display element that transmits a signal indicating one or both of a quantity or a property of the fiber material is located in the sliver can and is configured within the sliver can such that the signal is visible through the peripheral side wall from outside the accommodating space. The invention also encompasses a sliver can base configured with the display element and a spinning mill machine in combination with the sliver can.

16 Claims, 2 Drawing Sheets

(56) References Cited

U.S. PATENT DOCUMENTS

| | | | | |
|---|---|---|---|---|
| 5,575,040 | A | 11/1996 | Leifeld et al. | |
| 5,628,173 | A * | 5/1997 | Landmesser | B65H 67/0428 19/159 A |
| 6,923,549 | B2 * | 8/2005 | Hoy | A47G 19/2227 362/101 |
| 7,699,490 | B2 * | 4/2010 | Tsai | F21S 6/004 362/154 |
| 8,206,003 | B1 * | 6/2012 | LaBarge | F21V 33/004 362/154 |
| 9,144,335 | B2 * | 9/2015 | Walsh | A47G 19/2227 |
| 9,628,434 | B2 * | 4/2017 | Laidlaw | G10L 17/22 |
| 10,441,100 | B2 * | 10/2019 | O'Neal | G09F 23/00 |
| 2003/0090892 | A1 * | 5/2003 | Su | A47G 19/2227 362/101 |
| 2006/0219858 | A1 * | 10/2006 | Iacovino | A47G 23/02 248/311.2 |
| 2007/0091633 | A1 * | 4/2007 | Harrity | F21S 6/001 362/551 |
| 2010/0157579 | A1 * | 6/2010 | Kononuk | A47G 23/0309 362/101 |

FOREIGN PATENT DOCUMENTS

| | | |
|---|---|---|
| DE | 41 09 662 A1 | 9/1992 |
| EP | 0 528 907 A1 | 3/1993 |

* cited by examiner

SLIVER CAN INCLUDING A DISPLAY ELEMENT FOR DISPLAYING PROPERTIES OF THE FIBER MATERIAL

FIELD OF THE INVENTION

The present invention relates to a sliver can for accommodating a strand-shaped fiber material, comprising a peripheral, at least partially transparent side wall, via which an accommodating space for the fiber material is delimited. The can includes a can base, which is preferably vertically movable within the accommodating space, and at least one display element for displaying the quantity and/or at least one property of the fiber material located in the sliver can.

The invention also relates to a can base for guiding a strand-shaped fiber material in an accommodating space—which is delimited by a peripheral side wall—of an at least partially transparent sliver can.

Moreover, a spinning-mill machine comprising an interface for connection to a sliver can according to the invention is described.

BACKGROUND

Sliver cans are widely utilized in spinning mills as a storage and transportation medium for strand-shaped fiber material. A strand-shaped fiber material (also referred to as a sliver) of a corresponding spinning machine (for example, in the form of a spinning-mill preparation machine, in particular a draw frame, or a spinning machine, such as a rotor or air-jet spinning machine) is presented in the cans or is coiled into the cans again after having been processed in the spinning-mill machine.

The sliver cans usually comprise a round—as viewed in a top view—or rectangular side wall (=outer shell), and a can base, which delimits the accommodating space of the sliver can toward the bottom and on which the fiber material rests. The can base is preferably vertically guided through the side walls and is acted upon from underneath with a counterpressure, usually with the aid of an energy accumulator in the form of one or more spiral springs. This results in the desired constant loading of the fiber material during the coiling or withdrawal of the fiber material into or out of the sliver can, since the uppermost layer of the fiber material is consistently located in an optimal position for withdrawal and coiling, due to the movement of the can base. Due to the upwardly acting force of the energy accumulator, the can base of an empty sliver can is ideally raised up to the upper edge of the sliver can. During the coiling of the fiber material in the sliver can, the can base then continuously lowers due to the weight of the fiber material. This applies similarly for the withdrawal of the fiber material, wherein the can base moves slowly upward in this case.

From the related art, it is known with respect to sliver cans that a marking of the can is carried out with the aid of a rubber band in the upper area of the side wall. This enables the operator of the spinning machine to quickly identify the can contents, i.e., the type of fiber material coiled therein. This provides no information, however, regarding any other material-dependent parameters, such as the spinning-mill preparation machine from which the fiber material intermediately stored in the sliver can originated or the amount of fiber material remaining in the sliver can. It is disadvantageous in this connection that the application of the rubber band must be carried out manually by the operator, whereby a non-negligible outlay of time and costs results.

A self-testing sliver can comprising an LED display on the outer side, controlled by light barriers, which are vertically installed in a double-walled side wall of the can, is disclosed in CN 204454083 U. The light barriers deliver information regarding the amount of fiber material available in the accommodating space to a control unit located on the base. The vertically arranged illuminants on the outer side of the sliver can indicate, by illuminating, the amount of fiber material located in the accommodating space.

Such an approach for displaying the amount of fiber material is error-prone and cost-intensive, however, due to the large number of components. Moreover, this arrangement can be subsequently installed on existing sliver cans only with a great deal of effort.

SUMMARY OF THE INVENTION

A problem addressed by the present invention is that of eliminating the disadvantage of the related art.

The problem is solved by a sliver can, a can base, and a spinning machine having the features set forth herein.

Additional objects and advantages of the invention will be set forth in part in the following description, or may be obvious from the description, or may be learned through practice of the invention.

The invention relates to a sliver can comprising a display element, which is visible from outside the sliver can, i.e., through the side wall. The side wall of the sliver can consists of at least one material, which is transparent at least in sections, i.e., the side wall can be designed to be completely or only partially transparent, wherein the term "transparent" is also understood to refer to a material having translucent properties. A side wall, which is transparent at least in sections, is also understood to be a side wall, which is at least partially translucent. For example, a view pane of the side wall, which is made of transparent material, can be provided on a sliver can, preferably along the longitudinal axis.

A vertically movable can base is preferably placed in the accommodating space delimited by the side walls. A counterpressure is applied onto the can base in the vertical direction, so that the load on the fiber material remains constant during the coiling and the withdrawal from the sliver can. This is preferably ensured with the aid of an energy accumulator, for example, in the form of one or more spring elements. The distance between the can base and the actual bottom of the sliver can is therefore inversely proportional to the amount of fiber material located in the accommodating space. The said bottom is preferably connected to the side wall or is integrally formed therewith and preferably forms the support surface of the sliver can on a floor of a spinning mill.

According to the invention, it is provided that the display element is arranged in such a way that it is visible through the side wall from the outside, for example, through a transparent section of the side wall, or through the completely transparent outer wall. As a result, a quick detection of the display element is ensured, wherein a visual inspection of the sliver can, i.e., by looking through the upper opening of the accommodating space, is no longer necessary. This results in a faster recognition of the information represented by the display element.

In general, it is conceivable that information regarding the type and/or the amount (for example, the length) of the fiber material present in the sliver can is represented with the aid of the display element. It is also possible that the status of the sliver can, for example, whether the sliver can is ready to be filled or emptied at a spinning-mill machine or to be transported to a further spinning-mill machine, is displayed with the aid of the display element.

It is particularly advantageous when the display element comprises at least one illuminant or is formed by a illuminant. The at least one illuminant is preferably arranged in such a way that its direct light emission takes place through the side wall. It is also conceivable that the at least one illuminant is arranged in such a way that its light emission points toward the center of the can, so that only the reflection of the light beams is visible from outside the side wall.

In particular, it would be conceivable that the illuminant is designed as an active illuminant, i.e., as an illuminant operated with the aid of electrical energy. Alternatively, the illuminant can also be designed as a passive illuminant, i.e., without an explicit power supply. For example, such a passive illuminant could contain a fluorescent material. This would make an additional energy source superfluous.

In addition, it is particularly advantageous when the at least one illuminant or at least a portion thereof is designed as a light-emitting diode. As a result, the energy consumption and the stressing of the components by the waste heat of the illuminant during operation can be minimized. In addition, an illuminant designed in this way is low-cost, has a long service life, and requires little maintenance.

The illuminant is preferably designed in such a way that a plurality of different luminous colors can be represented. Additionally or alternatively, the illuminant can be designed in such a way that the luminosity is changeable. Due to a suitable combination of luminous color and/or luminosity, a plurality of properties with respect to the fiber material can be represented. The illuminant preferably comprises a control unit or is operatively connected to a control unit, which is designed for changing the luminosity and/or the luminous color, wherein the control unit is preferably activatable with the aid of an external input device, in particular contactlessly (for example, via Bluetooth or NFC). The external input device can be a mobile device (for example, a mobile phone) or a stationary input device of a spinning-mill machine, which is designed for interacting with the control unit of the illuminant.

It is advantageous when the display element is arranged on the can base. Preferably, the display element is arranged on the underside of the can base, i.e., with the emission direction in the direction of the aforementioned base of the sliver can. Additionally or alternatively, the display element, which can be formed by one or more LEDs, can also be arranged laterally, i.e., on the circumference of the can base, with the emission direction in the direction of the side wall.

Additionally or alternatively, the display element can also be arranged on the aforementioned bottom of the sliver can with the emission direction in the direction of the side wall and/or in the direction of the can base. Due to the movement of the can base in the axial direction during the withdrawal and the coiling of the fiber material into the sliver can, a passive representation of the fill level or the fill quantity is possible, i.e., without an additional control with the aid of a control unit. In this way, the fill quantity becomes apparent in a simple and quick manner and, primarily, from a distance, due to the illuminated can base and/or due to the illuminated installation space, which is defined by the side walls, the bottom of the sliver can, and the movable can base. In addition, due to this type of arrangement, it is ensured that the fill quantity can be read from all viewing angles.

In addition, it is conceivable that the display element is designed as a unit, which is removable, replaceable, and retrofittable on existing sliver cans. In addition, it is conceivable that this type of unit also contains a control unit and/or an electrical power supply, preferably according to the preceding description or the following description.

It is also advantageous when the sliver can comprises an electrical power supply for operating the display element. For example, the electrical power supply can be a rechargeable battery, which is located on the can base, on the sliver can wall, and/or at the base of the sliver can wall. As a result, the power supply of the display element, its attachments, and/or any other electronic components within the sliver can, such as the control unit of the display unit or of the sliver can, is possible regardless of the location of use and/or storage. It would be conceivable that the rechargeable battery is designed as a unit, which is removable, replaceable, and retrofittable on existing sliver cans. As a result, it is ensured that maintenance and assembly can be carried out quickly and easily.

Particular advantages are obtained when the sliver can comprises a charging unit for charging the rechargeable battery and/or for operating the display element. Preferably, the charging unit is arranged on the can base, on the side wall, and/or on the bottom of the sliver can. The charging unit can comprise, for example, a contactless interface for energy transmission, specifically with the aid of a resonant inductive coupling. The charging unit can additionally or alternatively also comprise a mechanical interface for energy transmission. The mechanical interface of the charging unit can be, for example, a plug connection or a sliding contact, or can comprise an appropriate element. As a result, the rechargeable battery can be charged, in particular during the utilization or intermediate storage of the sliver can at a spinning-mill machine or a spinning-mill preparation machine, primarily, however, without being withdrawn. In addition, it is conceivable that the interface of the charging unit effectuates the direct power supply of the display element and/or of the control unit, i.e., without an intermediate storage of the energy in the rechargeable battery.

Advantages are obtained when the sliver can comprises a control unit, which is operatively connected to the display element. This makes it possible to control the display element automatically, primarily, however, based on information from an external control system and/or with the aid of a sensor. The sensor can be, for example, a sensor, which monitors the fill level of the fiber material present in the sliver can, wherein the sensor can be part of the sliver can or a spinning-mill machine. The operative connection can be designed in such a way that the activation of the display element takes place contactlessly. In addition, it is conceivable to design the operative connection including a cable connection. It would be conceivable that the control unit is designed in such a way that the control unit is removable, replaceable, and retrofittable to existing sliver cans. As a result, it is ensured that maintenance and assembly can be carried out quickly and easily.

Moreover, the invention provides that the control unit is designed to be able to switch the illuminant on and off. This allows for an automatic shutoff in the case of non-use of the sliver can, for example, during storage, and an automatic switch-on during use of the sliver can on a spinning-mill machine or during the transport of the sliver can. This saves energy and increases the expected service life of the illuminant.

In addition, the control unit is preferably designed for changing the luminous color and/or the luminosity of the illuminant. In this way, depending on the ambient light and/or the actual utilization of the sliver can (waiting position at a spinning-mill machine, emptying or filling at a spinning-mill machine, or storage in the area of a sliver can storage location), the luminosity can be reduced, increased, or the illuminant can be switched on or off, in order to ensure good visibility of the display element, specifically of the illuminant, while saving a maximum amount of energy.

Moreover, the control unit can be designed for changing the luminous color of the illuminant. As a result, the sliver can may be color-coded, for example, on the basis of the fiber material located in the sliver can or on the basis of the fill level of the sliver can. The luminous color "green", for example, could represent a fiber material made of cotton, and the luminous color "blue" could represent a fiber material made of polyester. A representation, for example, of the quality of the fiber material, would also be conceivable. Moreover, it is conceivable to select the luminous color and/or the luminosity of the illuminant depending on the present spinning settings on a spinning machine. As a result, it is prevented that a wrong fiber material is delivered to a spinning station of the spinning machine, since the operator knows, for example, that only a fiber material, which is located in sliver cans whose display element is illuminated yellow, may be spun at the present time. A color coding therefore reduces the likelihood of confusion and, therefore, minimizes waiting times and costs in the production sequence.

Moreover, it is advantageous when the control unit is designed for receiving information regarding the quantity and/or at least one property of the fiber material located in the sliver can (for example, its material, length, absolute weight, sliver weight, spinning-mill preparation machine, which has coiled the fiber material into the can) from an external control system and/or a sensor and/or transmitting the information to the external control system and/or to the sensor. This allows for an automatic, self-changing coding, i.e., visual representation of the can contents and/or of the property or properties of the fiber material, whereby the sliver can and its contents are identifiable easily, quickly, and, primarily, from a distance.

It would be conceivable that the control unit is designed for receiving and/or transmitting the information wirelessly. This would make a sliver can identifiable in a wireless manner, for example, with the aid of an external control system, as represented in the following description. As a result, the traceability and the correct utilization of the sliver cans could be unambiguously ensured. Additionally or alternatively, the control unit can also be connected via a mechanical interface, for example, a plug connection or a sliding contact.

Moreover, the invention relates to a can base for guiding a strand-shaped fiber material in an accommodating space, which is delimited by a peripheral side wall, of a sliver can which is transparent at least in sections.

According to the invention, the can base comprises at least one display element for displaying the quantity and/or at least one property of the fiber material located in the sliver can.

In this case, the can base can preferably comprise one or more features according to the preceding description and/or the following description (such as a control unit and/or a rechargeable battery for supplying the display element and/or the control unit with electrical energy). In addition, one or more display elements according to the preceding description or the following description can be utilized.

Moreover, a spinning-mill machine is provided, which comprises a pick-up or set-down location for sliver cans, and comprises a removal unit for the fiber material located in the can and/or comprises a coiling unit for coiling a strand-shaped fiber material into a sliver can. The spinning-mill machine is, for example, a spinning-mill preparation machine (for example, in the form of a draw frame) or a spinning machine.

According to the invention, the spinning-mill machine comprises an electrical interface, which is designed for interacting with the display element and/or the control unit and/or the charging device of a sliver can and/or of a can base according to the preceding description and/or the following description.

An interface, which is designed as a contactless interface, would also be conceivable. As a result, a secure and simple transmission of the information and/or control signals between the aforementioned components would be ensured. This can prevent or at least reduce the downtime due to incorrect operation or incorrect placement of the sliver can. A mechanical connection would also be conceivable, for example, a plug connection or a sliding contact, which have a low radiation emission.

It is particularly advantageous when the interface is designed in such a way that it can enter into, or is in an operative connection with a control system of the spinning-mill machine. This would enable an integration of the interface into the existing spinning-mill machine control system. The control system of the spinning-mill machine can be designed, for example, in such a way that the display element is controllable via the interface according to the preceding description and/or the following description. This makes it possible to automatically switch the display element on and off, for example, after the removal and/or the coiling of the fiber material. This saves time as compared to the manual control of the display element and prevents errors.

Moreover, the control system can be designed in such a way that information can be received from the control unit of the sliver can via the interface. This makes it possible to automatically identify the quantity of fiber material and/or the type of fiber material, as well as any other further information regarding the fiber material. As a result, errors can be prevented already during the loading of the spinning-mill machine with the appropriate sliver cans.

Moreover, the control system can be designed in such a way that the control system can transmit information to the control unit of the sliver can. This makes it possible, for example, after the coiling of the fiber material, to automatically update the status of the sliver can (empty vs. full), wherein the updating takes place by changing one or more properties of the display element (for example, by changing the luminous color and/or luminosity of one or more luminous elements). The coiled fiber material can also be unambiguously electronically identified via the updating of the display element. This saves time and prevents errors resulting from a manual marking and identification of the sliver cans.

It is also advantageous when the interface is designed in such a way that it can supply the rechargeable battery of the sliver can with electrical energy. For example, the interface can be designed as a contactless interface, in particular including a resonant inductive coupling for supplying the energy. This can prevent or at least reduce the downtime due to incorrect operation or incorrect placement of the sliver can. A mechanical connection would also be conceivable, for example, a plug connection or a sliding contact, which have a low radiation emission.

BRIEF DESCRIPTION OF THE DRAWINGS

Further advantages of the invention are described in the following exemplary embodiments. Wherein.

DETAILED DESCRIPTION

Figure 1:
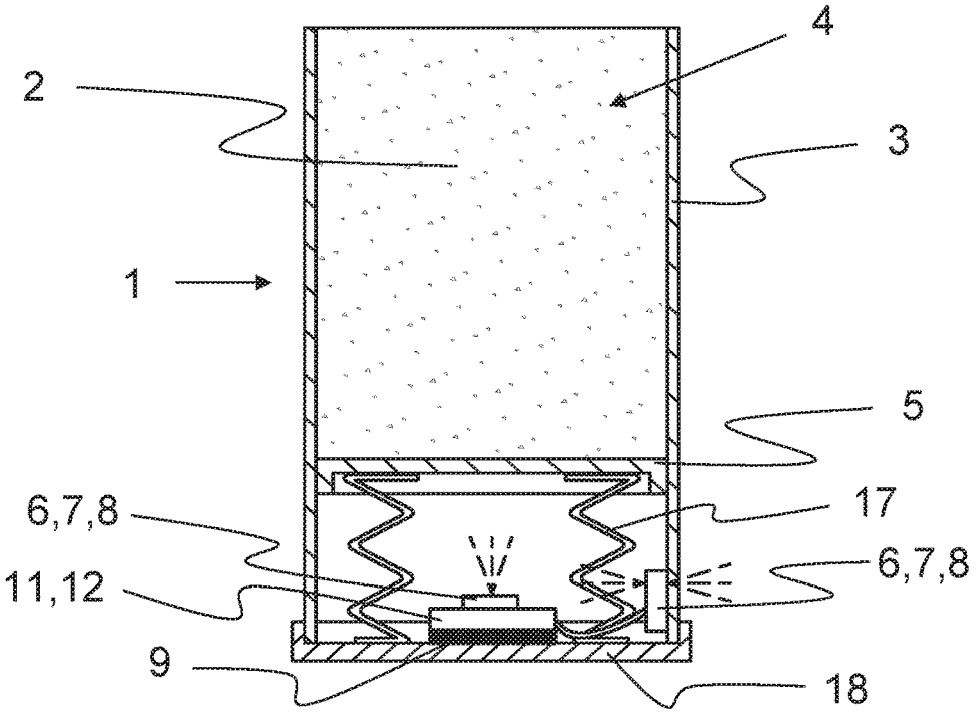
FIG. 1 shows a section of a sliver can according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures, the same reference signs are utilized for features which are identical and/or at least comparable in each of the various figures. The individual features, their embodiment and/or mode of operation are explained in detail usually only upon the first mention thereof. If individual features are not explained in detail once more, their embodiment and/or mode of operation correspond/corresponds to the embodiment and mode of operation of the features which act in the same way or have the same name and have already been described.

FIG. 1 shows, schematically and by way of example, a sectional view of an embodiment variant, according to the invention, of a sliver can 1 for storing a strand-shaped fiber material 2. The fiber material 2 is coiled into and drawn out of such sliver cans 1 between the working steps in the spinning mill. The loop-shaped coiling takes place, for example, with the aid of a particular can plate (not shown) on the can base 5.

Figure 2:
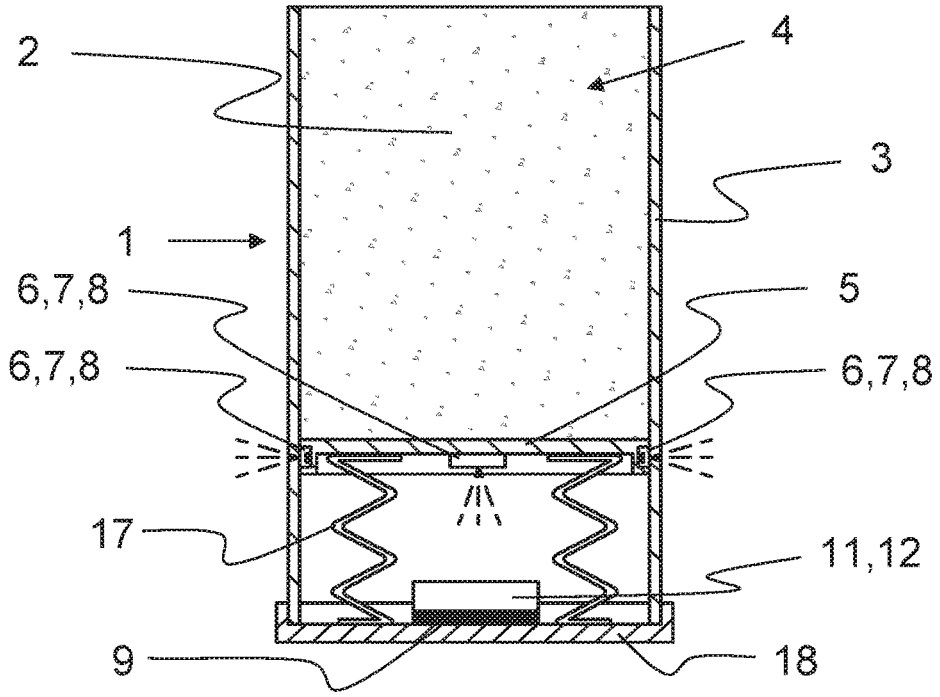
FIG. 2 shows a section of a further sliver can according to the invention.

The can plate is axially movable and is usually pressed in the direction of an upper sliver can opening with the aid of a spring system 17, which is represented in FIGS. 1 and 2 by the pair of springs. Due to this pressure, a frictional engagement arises between the fiber material 2 and the particular corresponding surfaces of the can base 5 and of the can plate. Due to the frictional engagement between the materials, a guidance of the fiber material 2 is ensured, whereby the fiber material 2 can be coiled in uniform loops in the sliver can 1.

Due to the increasing weight of the fiber material 2 located in the sliver can 1, the can base 5 is pressed uniformly downward in the direction of the bottom 18 of the sliver can 1. In the ideal case, this causes the frictional engagement between the aforementioned materials and surfaces to remain constant.

The relative distance of the movably mounted can base 5 to the bottom 18 of the sliver can 1 is therefore inversely proportional to the fiber material 2 located in the sliver can 1. In other words, the greater the distance is, the less fiber material 2 is present in the sliver can 1. Precisely, this relationship is therefore utilized as a suitable indicator for displaying the amount of fiber material.

The exemplary embodiment also shows the advantageously present electronic components. For example, a charging unit 11 and a control unit 12 are provided, wherein, in the case shown, the charging unit 11 can be inductively charged. An independent power supply in the form of a rechargeable battery 10 (FIG. 3) is not represented in this figure, although it is entirely conceivable in the present configuration.

The control unit 12 and the charging unit 11 are designed as a module in the embodiment variant shown. In this connection, however, a placement in separate areas of the sliver can 1, depending on the space required, would be conceivable.

Moreover, a display element 6 is provided according to the invention. In FIG. 1, the display element 6 consists of a single illuminant 7, which, for example, as a unit, can be located on the aforementioned module with an angle of departure (i.e., illumination) in the direction of the can base 5.

An attachment as an independent element, for example, on the side wall 3, would also be conceivable in this case, as is additionally represented in FIG. 1 (of course, it can be sufficient to implement only one of the two display elements). In the example shown, the angle of departure can point in the direction of the installation space between the can base 5, the side wall 3, and the bottom 18 of the sliver can 1, as well as in the direction of the side wall 3.

With respect to an angle of departure in the direction of the installation space, it is advantageous that the entire installation space can be illuminated. This results in good visibility of the display on the entire circumference of the sliver can 1.

The module shown in FIG. 1 is designed to be easily removed for maintenance or for replacement. In this way, this module can also be re-used if the sliver can 1 is destroyed.

In principle, an LED (light-emitting diode 8) can be selected as the illuminant 7. In this way, a plurality of different characteristic variables of the fiber material 2, such as the length-related weight or the type of material, can be represented with the aid of the control unit 12. It would be conceivable to design the light-emitting diode 8 as a multicolored diode, which can then represent the properties of the fiber material 2 or the attainment of a certain fill level of the sliver can 1 by changing colors.

FIG. 2 shows an alternative embodiment variant of FIG. 1. As is suggested by the comparison of the figures, the placement and number of installed components differ.

In the case of FIG. 2, the display elements are integrated into the can base 5. This variant is represented in the figure in two possible embodiments. On the one hand, it is conceivable to arrange at least one illuminant 7 on the underside of the can base 5. Therefore, the installation space underneath the can base 5 could be illuminated, as represented in FIG. 2.

Alternatively, it would also be possible to mount the display element 6 on the circumference of the can base 5. In this case, it is conceivable to utilize a single illuminant 7. This illuminant 7 would be visible from the outside from only one direction. In this connection, it therefore makes more sense to arrange a plurality in, preferably regular, intervals around the can base 5. As a result, the can base 5 and, therefore, the distance of the can base 5 to the bottom 18 of the sliver can 1 becomes visible as an illuminated ring. The fill level of the sliver can 1 is represented by the height of the ring, so that the can 1 can be switched in a timely manner. A cable line, for example, can be utilized for connecting the illuminant 7 and the control unit 12.

Figure 3:
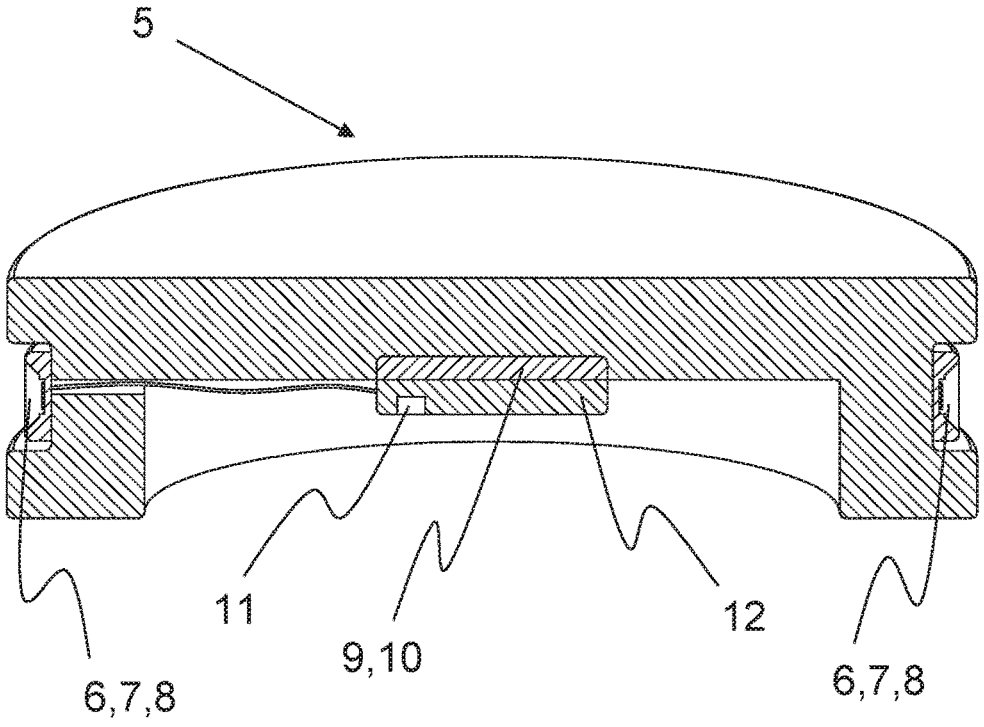
FIG. 3 shows a section of a can base according to the invention.

FIG. 3 shows an embodiment of a can base 5, according to the invention, as an autonomous functional unit. A can base 5 is represented, comprising a control unit 12, a charging unit 11, and an electrical energy supply 9 in the form of a rechargeable battery 10. In addition, the display element in this case contains a plurality of illuminants in the form of light-emitting diodes 8, which are arranged in a recess on the circumferential surface of the can base 5, which is specifically designed therefor. The control unit 12, the charging unit 11, and the rechargeable battery 10 form a jointly replaceable unit in this exemplary embodiment. Alternatively, these electronic components can also be designed as independent elements. Additionally or alternatively to positioning the display element 6 on the circumferential surface, an arrangement on the underside of the can base 5 is also possible.

Figure 4:
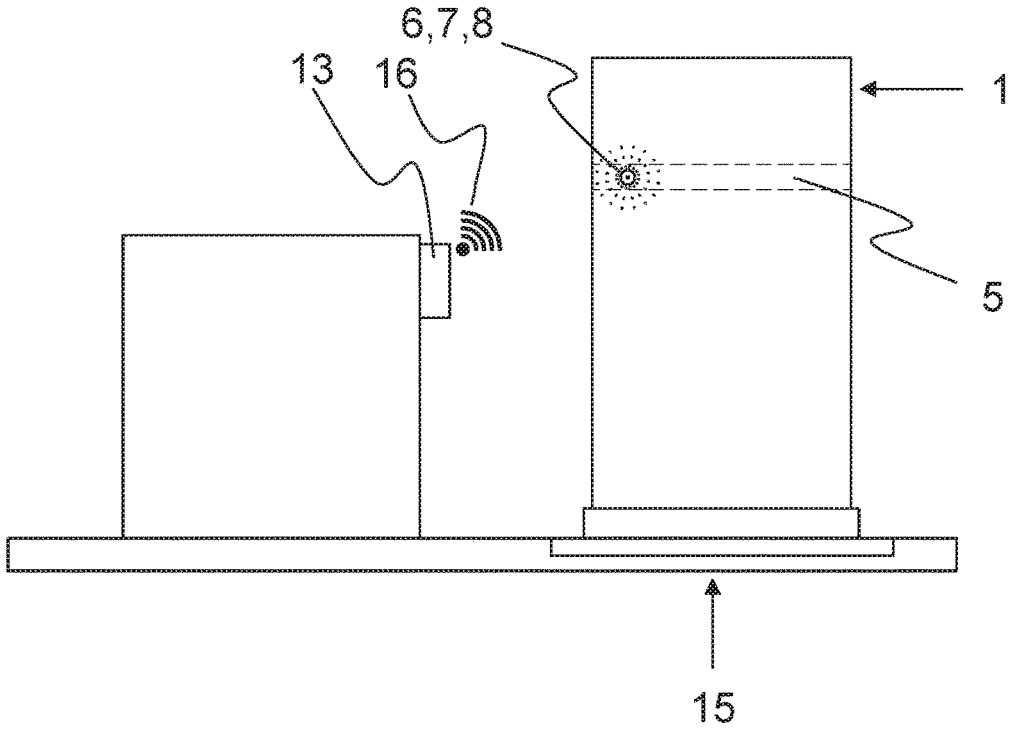
FIG. 4 shows a schematic view of a spinning-mill machine including a sliver can according to the invention.

FIG. 4 shows a schematic side view of a spinning-mill machine comprising a control system 13 and an interface 16 connected to the control system, wherein the interface 16 is designed for exchanging data with the control unit 12 of a sliver can 1. Moreover, an interface 15 for transmitting energy to the sliver can 1 is present.

Additionally, a sliver can 1 according to the preceding description is represented in its set-down location provided therefor. As compared to FIGS. 1 and 2, this sliver can 1 shows a smaller amount of fiber material, which is apparent due to the greater distance of the can base to the bottom 18 of the sliver can 1. In addition, in this representation, only one display element 6 is represented on the circumferential surface of the can base 5. In this representation variant, both the communication of the control system 13 of the spinning machine with the control unit 12 of the sliver can 1, as well as the energy transmission at the set-down location of the sliver can 1 between an energy source and the sliver can 1 or its display element 6, its control unit 12, and a charging device for a rechargeable battery 10, which may be present, take place in a contactless manner. The charging of the rechargeable battery 10 can therefore take place during the utilization of the sliver can 1.

The present invention is not limited to the represented and described exemplary embodiments. Modifications within the scope of the claims, as well as a combination of the features, even if they are represented and described in different exemplary embodiments, are an object of the invention.

LIST OF REFERENCE SKINS

1 sliver can
2 fiber material
3 side wall
4 accommodating space
5 can base
6 display element
7 illuminant
8 light-emitting diode
9 electrical power supply
10 rechargeable battery
11 charging unit
12 control unit
13 external control system
14 sensor
15 electrical interface
16 interface
17 spring system
18 bottom

The invention claimed is:

1. A sliver can for accommodating a strand-shaped fiber material, comprising:

a peripheral side wall that delimits an accommodating space for the fiber material, the peripheral side wall at least partially transparent;

a can base;

a display element that transmits a signal indicating one or both of a quantity or a property of the fiber material located in the sliver can; and the display element configured within the sliver can such that the signal is visible through the peripheral side wall from outside the accommodating space.

2. The sliver can as in claim 1, wherein the display element comprises an illuminant, wherein a luminous color or luminosity of the illuminant is changeable.

3. The sliver can as in claim 1, wherein the display element is arranged on one of: the can base; the side wall; or a bottom of the sliver can underneath the can base.

4. The sliver can as in claim 1, further comprising an electrical power supply for the display element.

5. The sliver can as in claim 4, wherein the electrical power supply comprises a rechargeable battery, and further comprising a charging unit for charging the rechargeable battery.

6. The sliver can as in claim 1, wherein the display element comprises an illuminant, and further comprising a control unit operatively connected to the display element for any one or combination of: switching the illuminant on an off; changing luminous color; or changing luminosity of the illuminant.

7. The sliver can as in claim 6, wherein the control unit is in communication with one or both of an external control system and a sensor, the control unit receiving information from or transmitting information to one or both of the external control system and the sensor regarding the quantity or property of the fiber material located in the sliver can.

8. A can base configured to guide a strand-shaped fiber material in an accommodating space delimited by a peripheral side wall of a sliver can, the can base comprising an upper surface, a lower surface, and a peripheral wall, the can base further comprising a display element mounted to the lower surface or to the peripheral wall of the can base, the display element transmitting a signal visible from outside of the sliver can through the peripheral side wall of the sliver can when the can base is within the sliver can indicating one or both of a quantity or a propel of the fiber material located in the sliver can.

9. The can base as in claim 8, wherein the display element comprises an illuminant, wherein a luminous color or luminosity of the illuminant is changeable.

10. The can base as in claim 8, further comprising an electrical power supply for the display element.

11. The can base as in claim 10, wherein the electrical power supply comprises a rechargeable battery, and further comprising a charging unit for the rechargeable battery.

12. The can base as in claim 8, further comprising a control unit operatively connected to the display element.

13. The can base as in claim 12, wherein the control unit is in communication with one or both of an external control system and a sensor, the control unit receiving information from or transmitting information to one or both of the external control system and the sensor regarding the quantity or property of the fiber material located in the sliver can.

14. A spinning-mill machine, comprising:

the sliver can as in claim 1;

an electrical interface for interacting with the display element.

15. The spinning-mill machine as in claim 14, further comprising a control system operatively connected to the electrical interface to control the display element.

16. The spinning-mill machine as in claim 14, wherein the sliver can further comprises a rechargeable battery for the display element that is recharged via the electrical interface.

* * * * *